United States Patent [19]

Stine

[11] 4,444,257

[45] Apr. 24, 1984

[54] METHOD FOR IN SITU CONVERSION OF HYDROCARBONACEOUS OIL

[75] Inventor: Laurence O. Stine, Western Springs, Ill.

[73] Assignee: UOP Inc., Des Plaines, Ill.

[21] Appl. No.: 215,995

[22] Filed: Dec. 12, 1980

[51] Int. Cl.[3] ..... E21B 43/24; E21B 43/243

[52] U.S. Cl. ..... 166/261; 166/302; 166/303

[58] Field of Search ..... 166/256, 261, 272, 302, 166/303

[56] References Cited

U.S. PATENT DOCUMENTS

| | | | |
|---|---|---|---|
| 2,857,002 | 10/1958 | Pevere et al. | 166/303 |
| 3,051,235 | 8/1962 | Banks | 166/261 |
| 3,208,514 | 9/1965 | Dew et al. | 166/272 X |
| 3,327,782 | 6/1967 | Hujsak | 166/261 |
| 3,342,260 | 9/1967 | Lumpkin | 166/261 |
| 3,598,182 | 8/1971 | Justheim | 166/272 X |
| 3,766,982 | 10/1973 | Justheim | 166/261 |

*Primary Examiner*—George A. Suchfield

*Attorney, Agent, or Firm*—James R. Hoatson, Jr.; John G. Cutts, Jr.; William H. Page, II

[57] ABSTRACT

A process for the in situ conversion of heavy hydrocarbonaceous crude oil containing indigenous trace metal which comprises heating said heavy hydrocarbonaceous oil in situ to a hydrocarbon conversion temperature, contacting the hot hydrocarbonaceous oil with hydrogen at a pressure from about 200 to about 5000 psig, and recovering the resulting converted hydrocarbonaceous oil.

2 Claims, No Drawings

METHOD FOR IN SITU CONVERSION OF HYDROCARBONACEOUS OIL

BACKGROUND OF THE INVENTION

The present invention is directed toward the in situ conversion and subsequent recovery of heavy hydrocarbonaceous crude oil. Although conventional crudes may be recovered by pumping and subsequent enhanced oil recovery procedures, the heavier crude oils which have been discovered resist the heretofor conventional techniques utilized for recovery. In any case, the recovery of crude oil is never complete and the utilization of conventional techniques for heavy crude recovery is even more bleak. For example, some of the heaviest crude oil deposits have a conventional recovery rate of approximately 5 percent. Moreover, such a heavy oil requires substantial processing in order to yield useful products.

Therefore, in order to recover greater quantities of the heavier crude oil, I propose to convert these crudes in situ with a combination of high temperature and high pressure hydrogen and to recover lighter and therefore more easily recoverable crude oil. In addition, many of the heavier crudes contain indigenous trace quantities of metals which may be made to perform a catalytic function in the conversion of the hydrocarbons to more valuable products. Such metals include nickel, vanadium, iron, etc. These metals may occur in a variety of forms. They may exist as metal oxides or sulfides introduced into the crude oil as metallic scale or similar particles, or they may exist in the form of water-soluble salts of such metals. Usually, however, they exist in the form of stable organometallic compounds, such as metal porphyrins and the various derivatives thereof.

In addition to organometallic compounds crude oils contain greater quantities of sulfurous and nitrogenous compounds than are found in lighter hydrocarbon fractions. For example, a heavy Venezuela crude also known as Orinoco Tar, having a gravity of 9.9° API at 60° F., contains about 1260 ppm vanadium, 105 ppm nickel, 11 ppm iron, 5.88 weight percent sulfur and about 0.635 weight percent nitrogen. Reduction in the concentration of the sulfurous and nitrogenous compounds to the extent that the crude oil is suitable for further processing is accomplished by conversion to hydrogen sulfide and ammonia.

BRIEF SUMMARY OF THE INVENTION

The object of the present invention is a process for the in situ conversion of heavy hydrocarbonaceous crude oil containing indigenous trace metal which comprises heating said heavy hydrocarbonaceous oil in situ to a hydrocarbon conversion temperature, contacting the hot hydrocarbonaceous oil with hydrogen at a pressure from about 200 to about 5000 psig, and recovering the resulting converted hydrocarbonaceous oil.

OBJECTS AND EMBODIMENTS OF THE INVENTION

The principal object of the present invention is the enhanced recovery of heavy hydrocarbonaceous crude oil. Another object of the invention is to at least partially hydroconvert the heavy crude oil in situ to aid the recovery thereof. Another object of the invention is the conversion of organometallic hydrocarbons. Yet another object is to utilize the indigenous metal compounds as a catalyst for the in situ hydroconversion of heavy crude oil.

DETAILED DESCRIPTION OF THE INVENTION

As hereinabove stated, the present invention principally involves a process for the in situ conversion of heavy hydrocarbonaceous crude oil containing indigenous trace metal which comprises heating said heavy hydrocarbonaceous oil in situ to a hydrocarbon conversion temperature, contacting the hot hydrocarbonaceous oil with hydrogen at a pressure from about 200 to 5000 psig, and recovering the resulting converted hydrocarbonaceous oil.

Preferred heavy hydrocarbonaceous crude oil for use in the instant invention are those crudes which do not readily lend themselves to conventional crude oil recovery; viz., pumping and enhanced oil recovery techniques. Suitable heavy crudes may have a gravity of less than about 20° API at 60° F., a melting point greater than about 100° F., and a trace metal content of greater than about 5 ppm by weight. Trace metal content of from about 5 ppm to about 50,000 ppm is suitable for purposes of the present invention. Suitable sources of heavy crude are found in such places as the Orinoco Tar Belt deposit in Venezuela, the heavy crudes of California and the Cold Lake deposits in Canada.

Although the conversion of heavy hydrocarbonaceous crudes is enhanced by the presence of catalyst, the in situ conversion of a viscous crude is extremely difficult if not impossible to perform due to the inability to obtain a homogeneous dispersion of catalyst throughout the crude oil to be converted. For this reason, the preferred hydrocarbon crude contains at least trace quantities of metal which are already in place and act as hydrocarbon conversion catalyst or catalyst precursors.

The conversion of heavy hydrocarbonaceous crude oil may be conducted at a temperature from about 400° F. to about 1400° F. and preferably at temperature from about 500° F. to about 900° F. After access to the heavy crude deposit is made, the crude is heated to reaction or conversion temperature. Various techniques may be utilized for such heating such as, for example, contact with super-heated steam, hot circulating oil, high temperature nitrogen streams, or electrical heating elements. Another heating technique is to inject air into the deposit and ignite a portion of the crude to furnish sufficient heat to increase the temperature of the portion of the crude which is to undergo hydroconversion.

After the heavy crude oil has been heated to at least about 400° F., elemental hydrogen is introduced to the site of the heated crude oil and the hydroconversion of the crude is allowed to proceed. The hydrogen injection stream generally is maintained at a temperature at least above ambient temperature in order to prevent or minimize the cooling of the heavy crude deposit below hydroconversion conditions.

In some cases, it may be advantageous to additionally heat the heavy crude oil deposit in the presence of hydrogen to ensure the desired hydroconversion. The process of hydroconversion is exothermic so that at least a portion of the heat required to maintain sufficient hydrocarbon conversion conditions is inherently produced.

In order to accelerate the rate of reaction for the hydroconversion process and to minimize any coking tendency, the hydroconversion is conducted at a pressure from about 100 to about 10,000 psig and preferably at a pressure from about 200 to about 5000 psig.

The amount of time required for the hydroconversion of the heavy crude oil deposits on the reaction zone temperature, the reaction zone pressure, the concentration of the indigenous trace metal which acts as catalyst, specific characteristics of the crude oil and the degree of conversion desired. Generally, the degree of conversion is sufficient if the volumetric recovery is significantly increased but in some cases, more highly refined crude oil may be desired. In any event, the reaction time in contact with hydrogen may suitably occur from a few minutes to several days.

Once the desired crude oil conversion is achieved, the crude is recovered utilizing conventional techniques known to those skilled in the art of oil recovery.

The following examples are presented in illustration of a preferred embodiment of the method of the present invention and are not intended as an undue limitation on the generally broad scope of the invention as set out in the appended claims.

EXAMPLE I

Conventional drilling techniques are utilized to gain access to a deposit of Orinoco Tar having the characteristics presented in Table I and approximately 5 volume percent of the deposit is recovered. No further recovery is deemed feasible utilizing conventional petroleum recovery techniques.

TABLE I

| ORINOCO TAR INSPECTION | |
|---|---|
| Gravity, °API at 60° F. | 9.9 |
| Sulfur, wt. % | 5.88 |
| Nitrogen, wt. % | 0.635 |
| Heptane Insoluble, wt. % | 12.7 |
| Metals, ppm | |
| Iron | 11 |
| Nickel | 105 |
| Vanadium | 1260 |
| Distillation | |
| IBP, °F. | 187 |
| 10% | 572 |
| 30% | 840 |
| 43% | 1000 |

EXAMPLE II

The drilling and recovery site of Example I is selected to demonstrate a preferred embodiment of the present invention. A fire flood is started in the tar deposit by injecting air and a source of ignition. A portion of the tar deposit is consumed by fire to furnish enough heat to raise the surrounding tar to a temperature of about 850° F. When the desired ambient tar temperature is reached, in this case 850° F., the air supply is discontinued in order to extinguish the fire. Then the hot tar deposit is pressured with hydrogen to approximately 1500 psig and is permitted to remain at hydroconversion conditions for 48 hours. During the conversion period, the consumed hydrogen is replenished to maintain the desired reaction pressure. After the hydroconversion is performed, an additional 15 volume percent of the tar deposit is recovered which now has the characteristics presented in Table II. Additionally for each barrel of tar produced, about 200 standard cubic feet of light hydrocarbon gases, including methane, ethane and propane, are recovered.

TABLE II

| CONVERTED ORINOCO TAR INSPECTION | |
|---|---|
| Gravity, °API at 60° F. | 14.0 |
| Sulfur, wt. % | 5.0 |
| Nitrogen, wt. % | 0.6 |
| Heptane Insoluble, wt. % | 11.0 |
| Metals, ppm | |
| Iron | 10 |
| Nickel | 100 |
| Vanadium | 1200 |
| Distillation | |
| IBP, °F. | 170 |
| 10% | 550 |
| 30% | 820 |
| 50% | 1000 |

The foregoing specification and examples clearly illustrate the improvement encompassed by the present invention and the benefits to be afforded therefrom.

I claim:

1. A process for the in situ catalytic conversion of a heavy hydrocarbonaceous crude oil having a gravity of less than about 20° API at 60° F.; a melting point greater than about 100° F. and a trace metal content of from about 5 ppm to about 50,000 ppm, wherein said trace metals are either vanadium, nickel, iron or a combination thereof, which process comprises:

(a) injecting ambient air into said crude oil;

(b) igniting said crude oil to consume a portion of tar deposits in said crude oil to raise the surrounding crude to a temperature in the range of from about 500° F. to about 1400° F.;

(c) discontinuing said injection of ambient air;

(d) contacting said hot crude oil in situ with hydrogen at a pressure of from about 200 to about 5000 psig to catalytically in situ hydroconvert at least a portion of said crude oil employing as a catalyst said indigenous vanadium, nickel, iron metals or combinations thereof in their trace quantities;

and (c) recovering said hydroconverted crude oil.

2. The process of claim 1 wherein said conversion is performed for about five minutes to five days.

* * * * *